US005636391A

United States Patent [19]

Greene, III

[11] Patent Number: 5,636,391

[45] Date of Patent: Jun. 10, 1997

[54] BABY BIDET FOR CLEANING A BABY

[76] Inventor: Jesse M. Greene, III, Rte. 1, Box 50, Olanta, S.C. 29114

[21] Appl. No.: 573,528

[22] Filed: Dec. 15, 1995

[51] Int. Cl.[6] ..... A47K 3/20

[52] U.S. Cl. ..... 4/420.3; 4/572.1; 4/621

[58] Field of Search ..... 4/420.3, 420.2, 4/420.1, 572.1, 579, 621, 641, 445, 446, 666, 661

[56] References Cited

U.S. PATENT DOCUMENTS

| | | | |
|---|---|---|---|
| 2,036,985 | 4/1936 | Salvoni | 4/420.3 |
| 2,053,594 | 9/1936 | Albert | 4/420.3 |
| 2,426,303 | 8/1947 | Graber . | |
| 2,947,995 | 8/1960 | Saulson . | |
| 3,034,137 | 5/1962 | Glou . | |
| 3,039,117 | 6/1962 | Hoskins . | |
| 3,377,629 | 4/1968 | Pasquale . | |
| 3,484,872 | 12/1969 | Romberge, Jr. . | |
| 3,490,079 | 1/1970 | Stolbach . | |
| 3,577,567 | 5/1971 | Wintercorn . | |
| 3,654,636 | 4/1972 | Restyanszki . | |
| 3,916,453 | 11/1975 | Dominguez-Armada . | |
| 4,152,788 | 5/1979 | Gomes . | |
| 4,326,308 | 4/1982 | Silver . | |
| 5,361,427 | 11/1994 | Wilk . | |
| 5,425,149 | 6/1995 | Crossley et al. | 4/572.1 |

*Primary Examiner*—David J. Walczak
*Attorney, Agent, or Firm*—Richard E. Jenkins, P.A.

[57] ABSTRACT

A baby bidet adapted to be placed on the top of the rim of a toilet bowl in order to facilitate cleaning a baby placed in the bidet, such as when changing a soiled diaper. The bidet is shaped so as to fit within and on the toilet bowl, and includes a sloping surface suitably sized to received the baby's bottom. The bidet also includes at least one rearwardly located ear that acts to engage the rim of the toilet bowl in its rear area and at least one forwardly located detent that acts to engage the rim of the toilet bowl in its front area so as to removably secure the baby bidet in place during use.

28 Claims, 5 Drawing Sheets

BABY BIDET FOR CLEANING A BABY

TECHNICAL FIELD

The present invention relates in general to a bidet that is portable and can be used on a toilet, and more particularly to an improved bidet adapted to facilitate cleaning a baby, such as during changing a soiled diaper.

BACKGROUND ART

In the past, it has been known to use a portable vessel for converting a toilet into a bidet. Such portable units are usually adaptable to any type of toilet and permit considerable savings in space and installation costs, as compared to a bidet fixture.

More particularly, U.S. Pat. No. 4,152,788 to Gomes shows a portable bidet adapted to be supported on a toilet bowl with the basin of the bidet extending downwardly into the toilet bowl, so that the user will straddle the bidet. A drain hole is provided in the bottom of the basin for emptying the basin into the toilet bowl, and a spray hose can be connected to a water faucet to supply water into the bidet.

Also, of interest is the portable bidet shown in U.S. Pat. No. 3,490,079 to Stolbach. The bidet is formed from rigid plastic and adapted to rest on a toilet bowl. The plastic container is formed so as to extend into and downwardly from the toilet bowl so that the user will straddle the bidet. Water or other suitable hygienic liquid is introduced into the bidet after it is secured in place on the toilet bowl. The bidet is formed with a drain hole in its vertical back wall and above the water line so that when the user is finished, the front end of the bidet can be raised and the liquid will flow through the hole and downwardly into the interior of the toilet bowl.

Of background interest are the sitz bath devices shown in U.S. Pat. No. 2,947,995 to Saulson; U.S. Pat. No. 3,034,137 to Glou; and U.S. Pat. No. 3,039,117 to Hoskins. Each of the sitz bath devices is adapted to be supported on a toilet bowl and provided with a liquid flow from an associated hose that is connected to a nearby faucet, such as from a bathroom sink.

However, none of the prior art has addressed the provision of a bidet adapted for cleaning a baby.

SUMMARY AND OBJECT OF THE INVENTION

Therefore, the present invention provides a portable bidet for holding a baby when cleaning the baby and adapted to be mounted on a bowl of a toilet, the bowl having a rim with a front edge and a rear edge. The bidet comprises a basin shaped to fit within and on the bowl. The basin has a wall, a front end region, a rear end region, and a bottom area, with the bottom area including a hole adapted to receive liquid from the basin and discharge the liquid into the bowl. Also, the bottom area includes a generally flat frame-shaped portion and defines a generally medially disposed sloping surface. The sloping surface is inclined downwardly from the front end region to the rear end region. Additionally, the sloping surface is attached to the frame-shaped portion with an oblique portion. The bottom area incudes at least one ear adapted to removably attach the bidet to the rear edge of the rim of the bowl. In one embodiment, at least one of the flat frame shaped portion or the oblique portion includes the at least one ear. As a result, when the bidet is positioned on the bowl, the front end region is adjacent to and extending laterally over and outwardly from the front edge of the rim and the frame-shaped portion is generally horizontally disposed and the wall is generally vertically disposed.

The present invention also provides a process for cleaning a baby. The process comprises providing a toilet having a bowl, the bowl having a rim with a front edge and a rear edge and providing a portable bidet as described in the paragraph above. Then, the bidet is positioned on the bowl, with (i) the ear removably attached to the rear edge of the rim of the bowl, (ii) the front end region adjacent to and extending laterally over and outwardly from the front edge of the rim, (iii) the frame-shaped portion generally horizontally disposed, and (iv) the wall generally vertically disposed. After positioning the bidet on the bowl, the baby is placed in the bidet and cleaned.

Accordingly, it is an object of the invention to provide an easy and sanitary diaper change procedure and bidet therefor, resulting in less baby rash than conventional diaper changing procedures.

Some of the objects of the invention having been stated above, other objects will become evident as the description proceeds, when taken in connection with the accompanying drawings as best described below.

DETAILED DESCRIPTION OF THE INVENTION

Figure 1A:
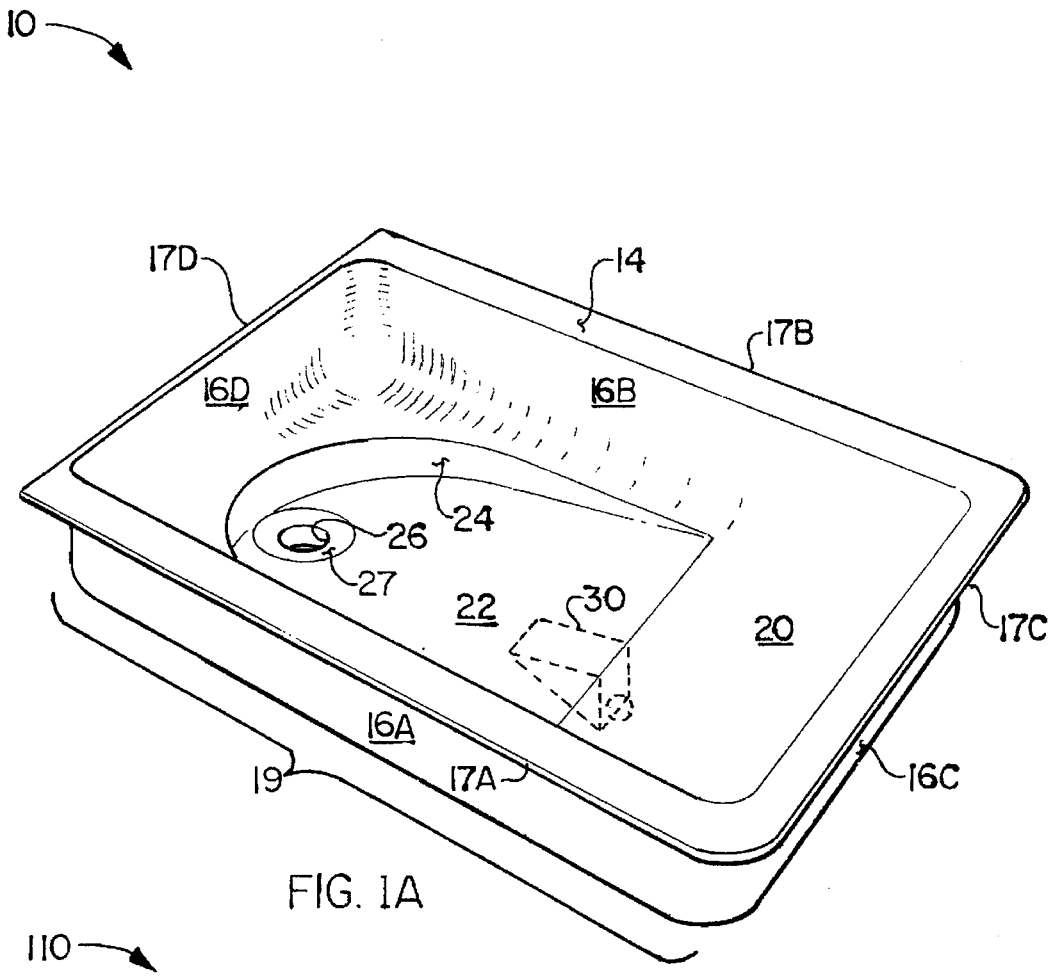
FIG. 1A is a perspective view of the baby bidet of the present invention.
Figure 1B:
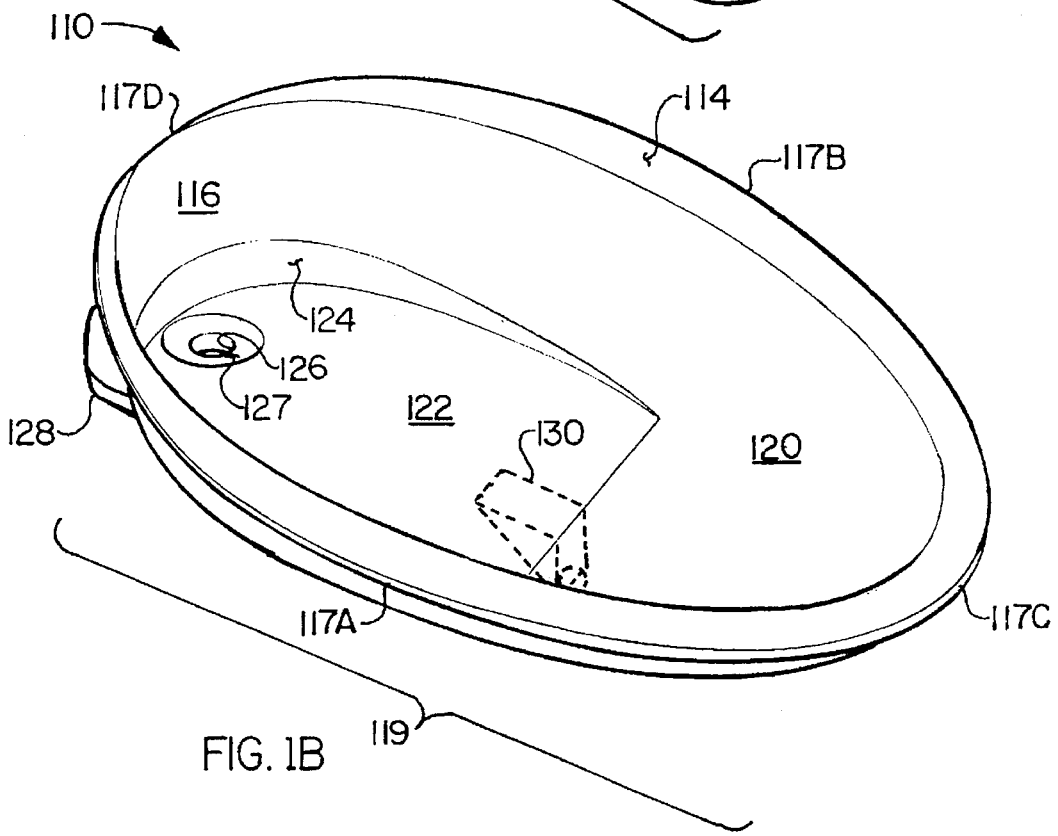
FIG. 1B is a perspective view of an alternative embodiment of the baby bidet of the present invention.
Figure 2:
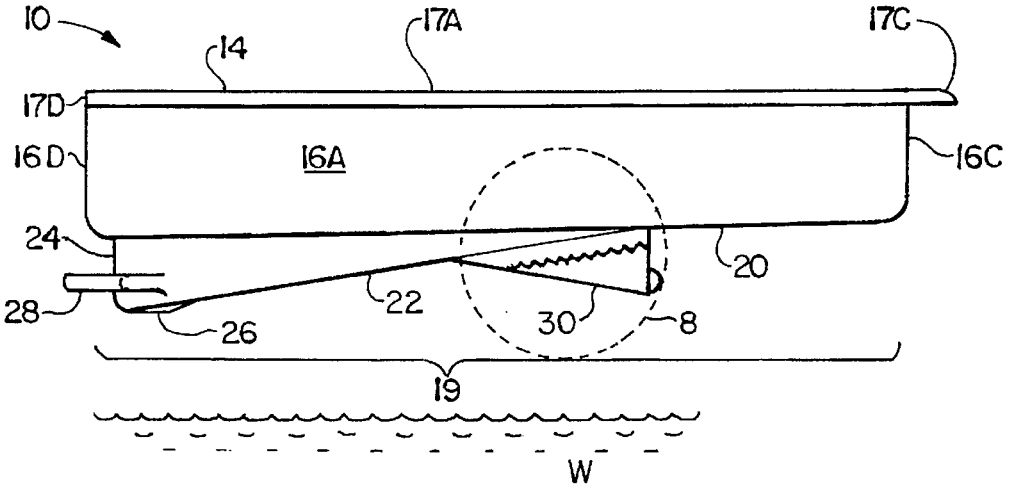
FIG. 2 is a side view of the baby bidet shown in FIG. 1A.
Figures 3A, 3B:
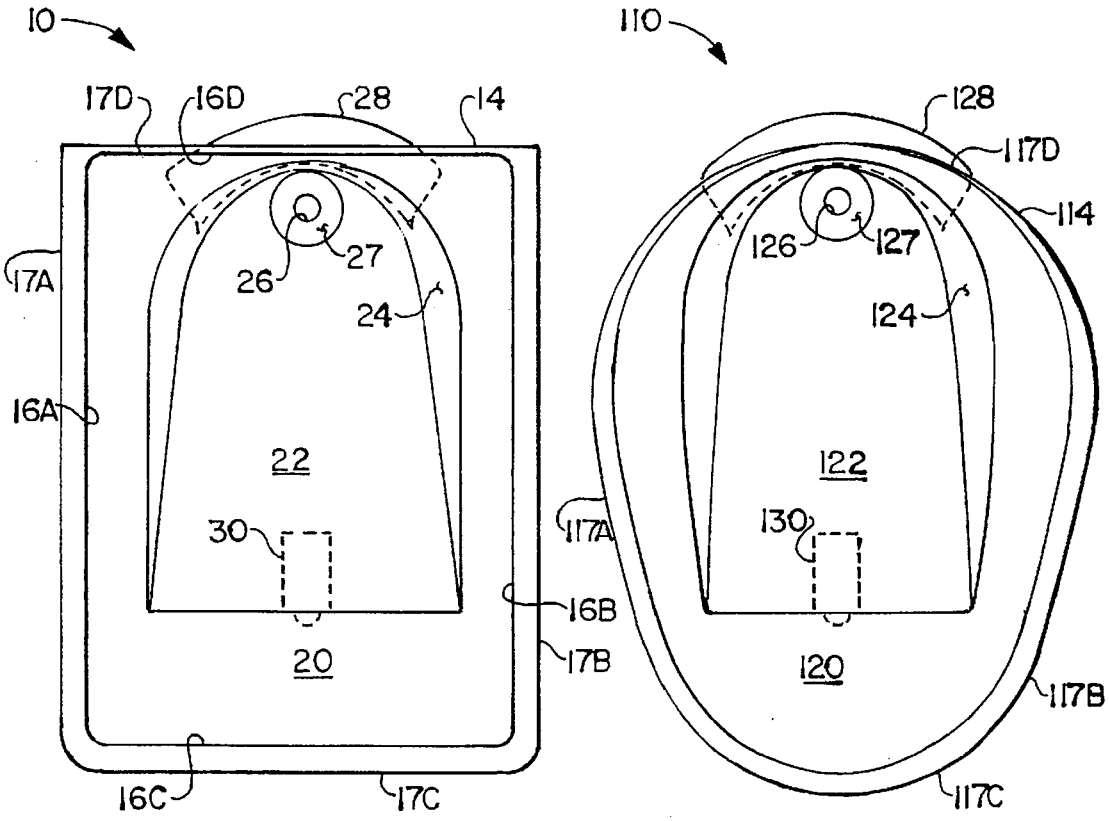
FIG. 3A is a top view of the baby bidet shown in FIG. 1A.
FIG. 3B is a top view of the baby bidet shown in FIG. 1B.
Figure 4A:
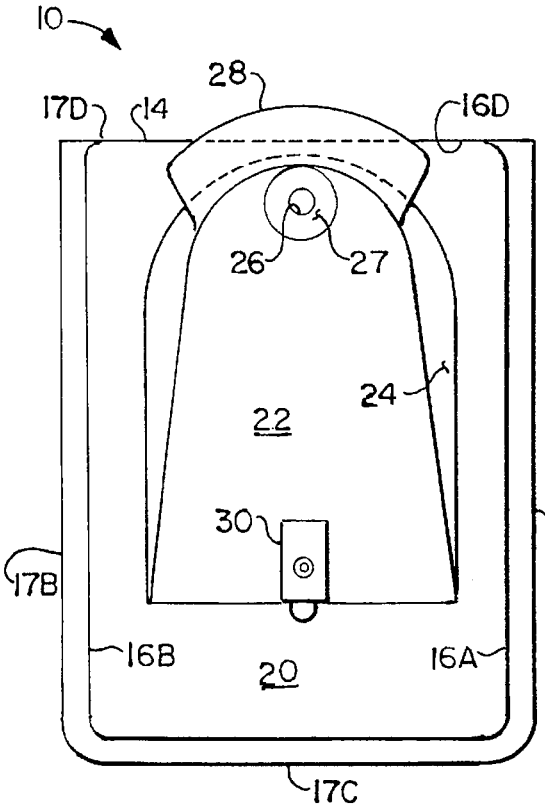
FIG. 4A is a bottom view of the baby bidet shown in FIG. 1A.
Figure 4B:
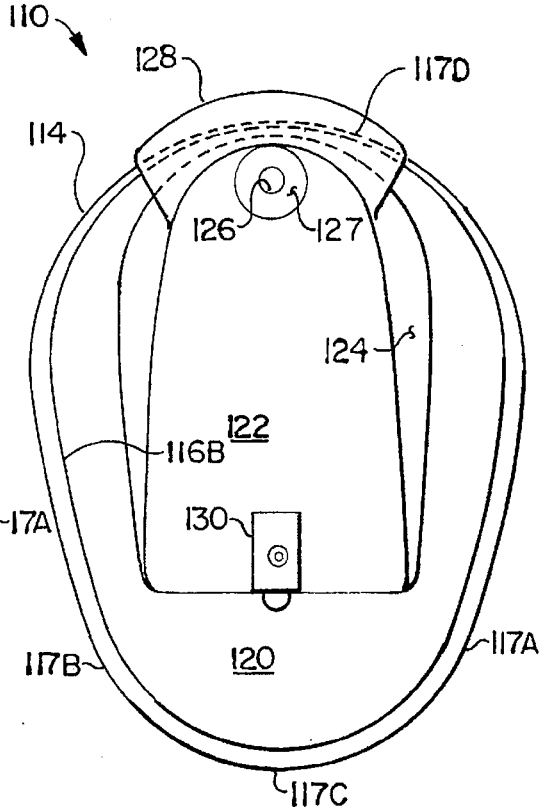
FIG. 4B is a bottom view of the baby bidet shown in FIG. 1B.
Figure 5A:
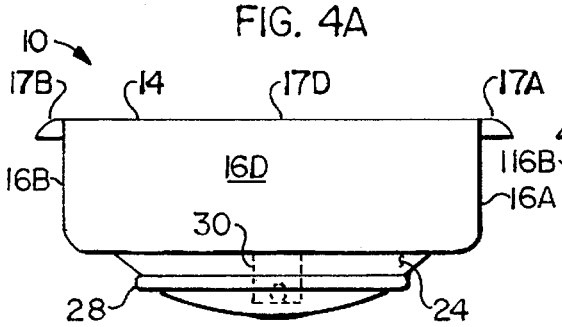
FIG. 5A is a rear view of the baby bidet shown in FIG. 1A.
Figure 5B:
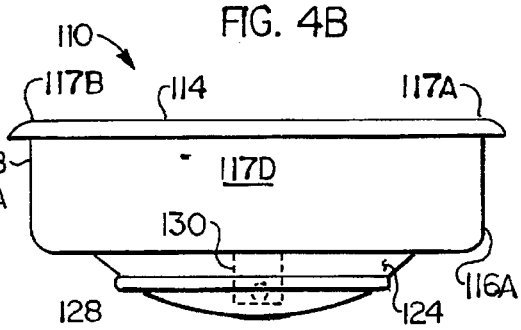
FIG. 5B is a rear view of the baby bidet shown in FIG. 1B.
Figure 6A:
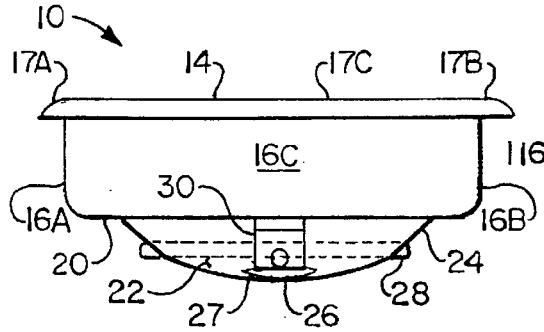
FIG. 6A is a front view of the baby bidet shown in FIG. 1A.
Figure 6B:
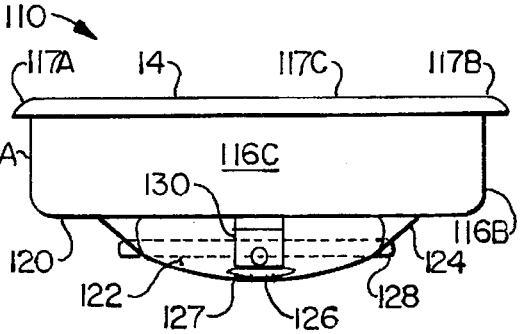
FIG. 6B is a front view of the baby bidet shown in FIG. 1B.

In FIGS. 1A, 2, 3A, 4A, 5A, 6A, and 7, a portable baby bidet 10 is illustrated comprising basin 14 including first and second side regions 17A, 17B, front end region 17C, rear end region 17D, and bottom area 19. Bottom area 19 includes generally flat bottom portion 20, sloping surface 22, oblique portion 24, drain hole 26 (having optional depression 27 thereabout), at least one ear 28 and at least one detent 30. Detent 30 is shown in greater detail in FIG. 8.

Toilets typically have one of four combinations of width and length (10×14 inches, 11×13 inches, 9.75×12.5 inches, or 9.5×14.5 inches) for the opening of the toilet bowl, and as described in more detail below, basin 14 is suitably sized to fit on standard toilet T (shown in FIG. 7). Also, an associated hose may be provided together with bidet 10, for instance, hose H schematically shown in FIG. 7 removably connected to proximate water faucet WF, such as from a sink or a bathtub.

More particularly, basin 14 has a peripheral wall which is generally vertically disposed when basin 14 is placed on toilet T, and which, in the embodiment of bidet 10 illustrated FIGS. 1A, 2, 3A, 4A, 5A, 6A, and 7, is generally square or rectangular in shape. Accordingly, bidet 10 includes first and second side walls 16A, disposed at respective first and second side regions 17A, 17B of bidet 10, front wall 16C disposed at front end region 17C of bidet 10, and rear wall 16D disposed at rear end region 17D of bidet 10.

The bidet and thus the peripheral wall need not be square or rectangular in shape as shown in FIGS. 1A, 2, 3A, 4A, 5A, 6A, and 7, but may be of other shapes, such as trapezoidal, octagonal, hexagonal, round, and the like (not shown). For instance, shown in FIGS. 1B, 3B, 4B, 5B, and 6B is an alternative embodiment of bidet 10 that is generally the same as bidet 10 except bidet 110 comprises a generally oval-shaped basin 114 including one continuous oval-shaped peripheral wall 116 (that is generally vertically disposed when bidet 110 is placed on a toilet). Thus, basin 114 includes first and second side regions 117A, 117B, front end region 117C, rear end region 117D, bottom area 119; and bottom area 119 includes generally flat bottom portion 120, sloping surface 122, oblique portion 124, drain hole 126 (having optional depression 127 thereabout), at least one ear 128, and at least one detent 130.

With reference again to bidet 10, bottom area 19 (see FIGS. 2 and 7) of bidet 10 includes portion 20, which is suitably frame-shaped and has a generally flat surface to rest upon rim R when basin 14 is placed on toilet T. When so placed, portion 20 is generally horizontally disposed.

Also, bottom area 19 defines a medial sloping or inclined surface 22 that slopes downwardly from the region of front end 17C to the region of rear end 17D, and sloping surface 22 is joined to flat, frame-shaped bottom portion 20 by oblique portion 24. Oblique portion 24 should be curved or arced approximately to the same extent as rear edge RE of rim R of bowl B of toilet T for optimal securement of bidet 10 thereto, as further described below. Sloping surface 22 and oblique portion 24 are of a suitable size to hold a baby's bottom when a baby is placed in bidet 10 (see FIG. 7).

Furthermore, bottom area 19 is provided with drain hole 26, suitably disposed in sloping surface 22 and proximate to oblique portion 24, and adapted for draining water or other liquid and waste from bidet 10 into toilet T. Drain hole 26 should be provided with circumferential depression 27 thereabout in order to aid in preventing liquid from standing on sloping surface 22 proximate to oblique portion 24, thereby aiding in removal of water and waste. Alternatively (not shown), drain hole 26 and optional circumferential depression 27 may be disposed in oblique portion 24, suitably at the bottom of its center. Also (not shown), a plug or similar member may be provided as a closure for drain hole 26.

Figure 7:
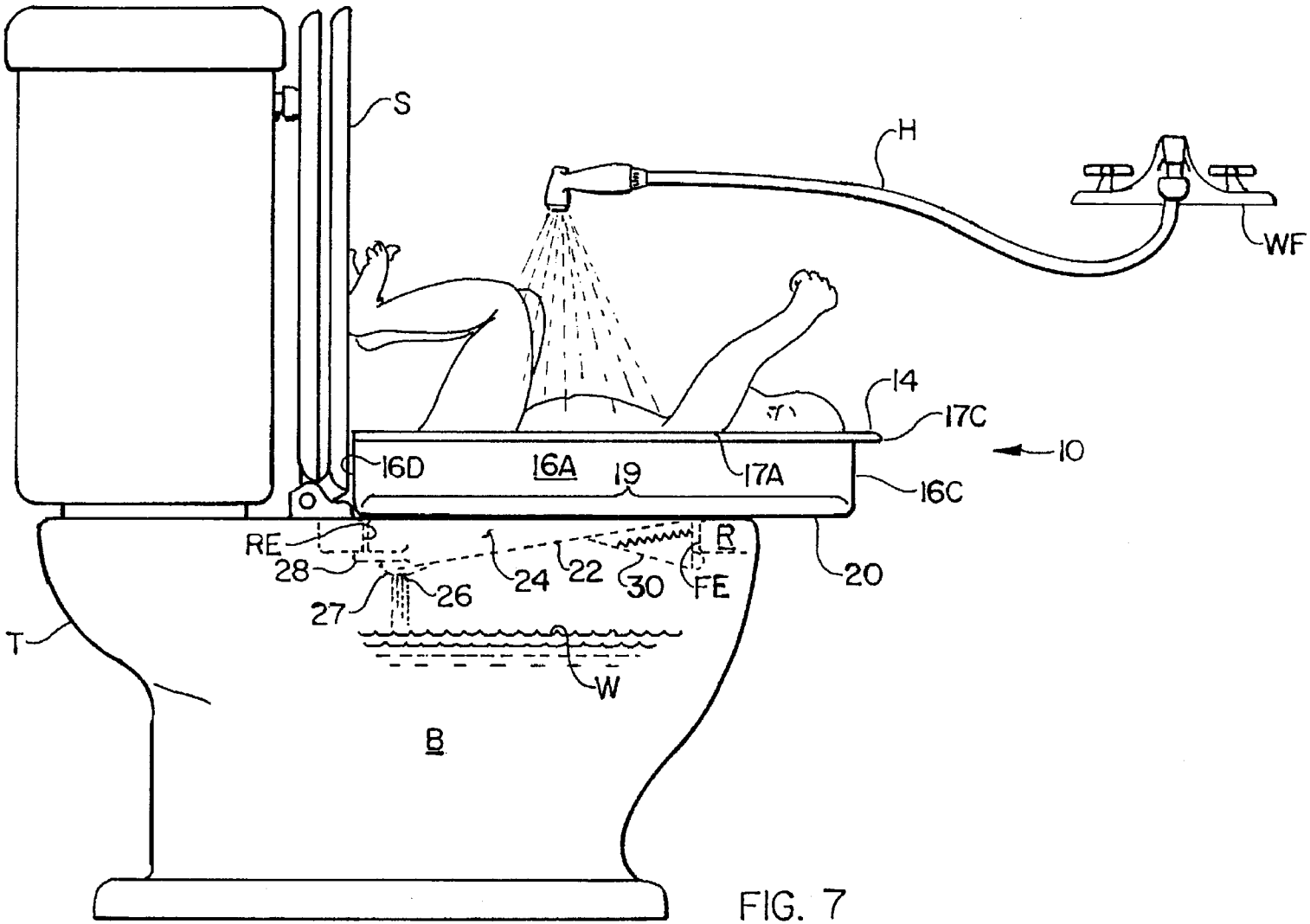
FIG. 7 is a side view of the baby bidet shown in FIG. 1A, but with a baby inside and with the bidet attached to a toilet, and also showing a schematic illustration of a hose attached to a faucet and usable with the baby bidet.
Figure 8:
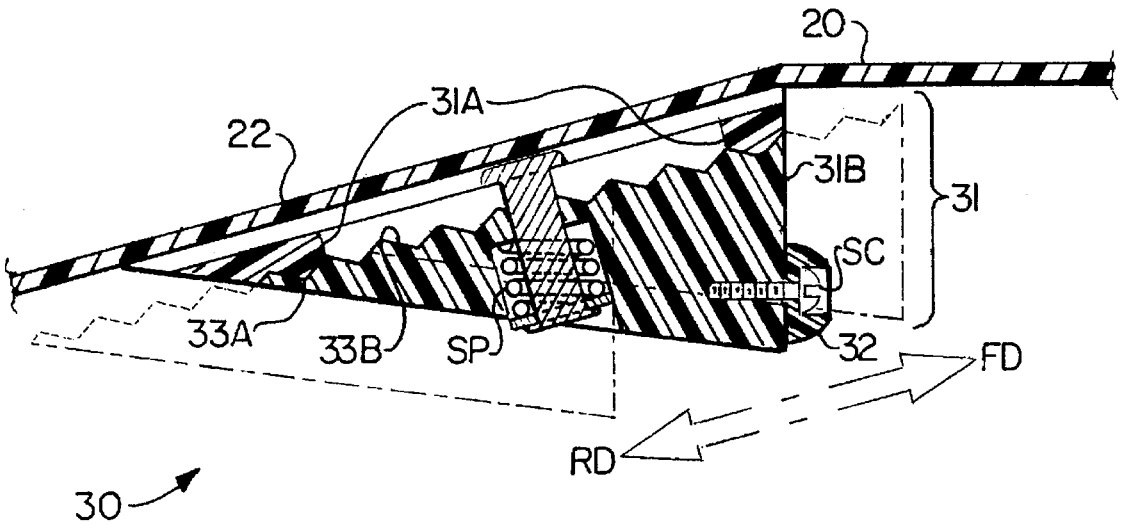
FIG. 8 is an enlarged view of the detent portion of the baby bidet that is inside the dotted circle in FIG. 2.

As can be better seen with reference to FIG. 7, affixed to bottom area 19, preferably to oblique portion 24, is ear 28 that may be formed of substantially any desired size and shape as a matter of design choice and that is adapted for removably attaching bidet 10 securely in place to rear edge RE of rim R with toilet seat S in its raised position. Alternatively (not shown), ear 28 instead may be affixed to sloping surface 22 proximate to oblique portion 24. Optionally, two or more smaller ears 28 may be affixed to bottom area 19 as a matter of design choice.

Furthermore, affixed to bottom area 19, preferably to sloping surface 22, is adjustable detent 30 (see FIG. 7 and also see enlargement in FIG. 8) that may be formed of substantially any desired size and shape as a matter of design choice. Detent 30 includes wedge 31 having first and second portions 31A and 31B, with depressible rubber hemisphere 32 attached, such as by screw SC, to second portion 31B, and is thereby adapted for removably attaching bidet 10 securely in place to front edge FE of rim R with toilet seat S in its raised position.

More particularly, first portion 31A is affixed to sloping surface 22, and reciprocally engaging slots or teeth 33A, 33B are provided respectively on first portion 31A and second portion 31B. As a result, detent 30 is adjustable back and forth for about 3 inches in rearward RD direction toward oblique portion 24 or for about 3 inches in forward direction FD toward front wall 16C Specifically, the adjustment may be accomplished such as by spring SP being pulled downwards in order to lower second portion 31B of detent 30 and thus disengage teeth 33A, 33B. Then, second portion 31B can be moved back and forth in rearward direction RD or forward FD direction to accommodate most common sizes of bowl B (for instance, the above-noted sizes of 10×14 inches, 11×13 inches, 9.75×12.5 inches, or 9.5×14.5 inches), and then teeth 33A, 33B are re-engaged by releasing spring SP so that second portion 31B secured in place after adjustment. Adjustment may also be accomplished with a screw and nut (not shown) instead of spring SP.

Optionally, more than one detent 30 may be affixed to sloping surface 22. Nevertheless, in the preferred embodiment, when one ear 28 is present and one detent 30 is present, ear 28 preferably should be located at the center of oblique portion 24 and detent 30 should be located at the center of and toward the end of sloping surface 22, where sloping surface 22 joins flat, frame-shaped bottom portion 20.

Typically, there are about 20 holes (not shown) in the inside of rim R of a standard toilet T that allow water W to wash the inside of bowl B during flushing of toilet T. Accordingly, ear 28 (or 2 ears, or 3 ears, etc., not shown) and detent 30 (or 2 detents, or 3 detents, etc., not shown) should be positioned on bottom area 19 so as not to interfere with the down flow of water coming from rim R during flushing.

When bidet 10 is placed on toilet T, flat, frame-shaped bottom portion 20 rests on top of rim R. Also, part of flat, frame-shaped bottom portion 20 by the region of front end 17C is adjacent to and extends laterally over and outwardly from front edge FE of rim R and sloping surface 22 projects downwardly and into bowl B. Ear 28 securely engages rear edge RE of rim R and detent 30 by way of depressible rubber hemisphere 32 securely engages front edge FE of rim R to stabilize bidet 10. Thus, in use, bidet 10 is secured via ear 28 to rear edge RE of rim R and via detent 30 to front edge FE of rim R so that a baby (see FIG. 7) may be placed in bidet 10 with his/her head directed toward front end region 17C, i.e., proximate to front wall 16C, for cleaning the baby, such as during diaper changing after the soiled diaper has been removed from the baby. If desired, associated spray hose A may be attached to water faucet WF and utilized to cleanse the baby, such as to spray the baby with water to help remove any remaining urine or fecal matter from the baby. The rinse water flushes through hole 26 into bowl B. The result is an easy and sanitary diaper change procedure that results in less baby rash than conventional diaper changing procedures.

For optimal securement of bidet 10 to rear edge RE and front edge FE of rim R, the following dimensions should be employed.

Preferably, bidet 10 is about 22 inches long (in the direction from front end 17C to rear end 17D) and 15 inches wide (in the direction from side 17A to side 17B). The height of peripheral walls 16A, 16B, 160, 16D is desirably about 4 inches to about 6 inches.

Flat, frame shaped portion 20 should be about 60% to about 80% of bottom area 19. Sloping surface 22 should be about 20% to about 40% of bottom area 19 and about 12 inches long (in the direction from front end 17C to rear end 17D) and about 7.5 inches wide (in the direction from side 17A to side 17B). Sloping surface 22 should be at an angle less than about 20 degrees with respect to flat, frame shaped portion 20 for optimal drainage of liquid through drain hole 26. The distance from where sloping surface 22 joins flat, frame shaped portion 20 to front wall 16C should be about 10 inches to about 15 inches.

Oblique portion 24 at its tallest center part, should be about 2 inches in vertical height. The distance from the tallest center part of oblique portion 24 to rear wall 16D should be about 0.5 inch.

Drain hole 26 should have a total depth (which includes the depth of depression 27) of about 1.0 inch and a diameter of about 1.5 inches. Depression 27 should have a depth of about 0.5 inch and a diameter of about 2.5 inches.

The 2 inch vertical height of oblique portion 24 plus the 1 inch total depth of drain hole 26 are suitable so that with bidet 10 resting on toilet T, the bottom-most part of bidet 10 will be about 5 inches above the typical level of water W in bowl B, and when toilet T is flushed and the level of water W rises in bowl B during flushing, the bottom-most part of bidet be will be about 4 inches above the level of water W. Ear 28 should be about 1 to about 1.5 inches in length and about 1.5 inches to about 6.5 inches in width.

The portable baby bidet may be molded from re-enforced plastics materials so that it is light in weight, has adequate strength, and is easy to handle and store. Additionally, it can also be formed by laminating layers of similar materials that are adapted to the specific use for which the bidet is employed. It can also be formed of a thin metal sheet.

It will be understood that various details of the invention may be changed without departing from the scope of the invention. Furthermore, the foregoing description is for the purpose of illustration only, and not for the purpose of limitation—the invention being defined by the claims.

What is claimed is:

1. A portable bidet for holding a baby when cleaning the baby and adapted to be mounted on a bowl of a toilet, the bowl having a rim with a front edge and a rear edge, said bidet comprising: a basin shaped to fit within and on the bowl; and the basin having a wall, a front end region, a rear end region, and a bottom area; and the bottom are including (i) a hole adapted to receive liquid and fecal matter from the basin and discharge the liquid and fecal matter into the bowl, (ii) a generally flat portion defining a generally medially disposed generally flat portion defining a generally medially disposed sloping surface therein, with the sloping surface being inclined downwardly from the front end region to the rear end region, (iii) an oblique portion joining the sloping surface to the generally flat portion, (iv) at least one ear adapted to removably attach the bidet to the rear edge of the rim of the bowl, and (v) at least one detent adapted to removably attach the bidet to the front edge of the rim of the bowl; such that when the bidet is positioned on the bowl, the front end region is adjacent to and extends laterally over and outwardly from the front edge of the rim and the generally flat portion is generally horizontally disposed and the wall is generally vertically disposed.

2. The portable bidet of claim 1, wherein the bidet is about 22 inches long and about 15 inches wide, and the wall is about 4 inches to about 6 inches high.

3. The portable bidet of claim 1, wherein the wall has a shape selected from the group consisting of oval, rectangular, and combinations thereof.

4. The portable bidet of claim 1, wherein the hole is disposed in at least one of the sloping surface and the oblique portion.

5. The portable bidet of claim 1, wherein the generally flat portion is generally frame-shaped and is about 60% to about 80% of the bottom area.

6. The portable bidet of claim 1, wherein the sloping surface is about 20% to about 40% of the bottom area and about 12 long and about 7.5 inches wide.

7. The portable bidet of claim 1, wherein the sloping surface is at an angle less than about 20 degrees with respect to the generally flat portion.

8. The portable bidet of claim 1, wherein the oblique portion at its tallest part is about 2 inches high.

9. The portable bidet of claim 1, wherein the oblique portion is arced approximately to the same extent as the rear edge of the rim.

10. A portable bidet for holding a baby when cleaning the baby and adapted to be mounted on a bowl of a toilet, the bowl having a rim with a front edge and a rear edge, said bidet comprising: a basin shaped to fit within and on the bowl; and the basin having a wall, a front end region, a rear end region, and a bottom area; and the bottom area including (i) a hole adapted to receive liquid from the basin and discharge the liquid into the bowl, (ii) a generally flat portion defining a generally medially disposed sloping surface therein, with the sloping surface being inclined downwardly from the front end region to the rear end region, (iii) an oblique portion joining the sloping surface to the generally flat portion, (iv) at least one ear adapted to removably attach the bidet to the rear edge of the rim of the bowl, and (v) at least one detent adapted to removably attach the bidet to the front edge of the rim of the bowl; such that when the bidet is positioned on the bowl, the front end region is adjacent to and extends laterally over and outwardly from the front edge of the rim and the generally flat portion is generally horizontally disposed and the wall is generally vertically disposed, and wherein at least one of the sloping surface and the oblique portion of the bottom area includes the at least one ear.

11. A portable bidet for holding a baby when cleaning the baby and adapted to be mounted on a bowl of a toilet, the bowl having a rim with a front edge and a rear edge, said bidet comprising: a basin shaped to fit within and on the bowl; and the basin having a wall, a front end region, a rear end region, and a bottom area; and the bottom area including (i) a hole adapted to receive liquid from the basin and discharge the liquid into the bowl, (ii) a generally flat portion defining a generally medially disposed sloping surface therein, with the sloping surface being inclined downwardly from the front end region to the rear end region, (iii) an oblique portion joining the sloping surface to the generally flat portion, (iv) at least one ear adapted to removably attach the bidet to the rear edge of the rim of the bowl, and (v) at least one detent adapted to removably attach the bidet to the front edge of the rim of the bowl; such that when the bidet is positioned on the bowl, the front end region is adjacent to and extends laterally over and outwardly from the front edge of the rim and the generally flat portion is generally horizontally disposed and the wall is generally vertically disposed, and wherein the at least one detent includes a wedge with a depressible rubber hemisphere attached thereto.

12. The portable bidet of claim 11, wherein the wedge has first portion and a second portion and the first portion is affixed to the sloping surface, the depressible rubber hemisphere is attached to the second portion, and reciprocally engaging first and second teeth are provided respectively on first and second portions, so that detent is adjustable back and forth.

13. The portable bidet of claim 1, wherein the bidet is constructed of a material selected from the group consisting of plastic, metal, and a combination thereof.

14. The portable bidet of claim 1, further including an associated spray hose adapted to be removably connected to a water faucet such that when the hose is connected to the water faucet and the water faucet is turned to its on position, water will flow through the hose and into the bidet for cleaning the baby.

15. A process for cleaning a baby comprising:

(A) providing a toilet having a bowl, and the bowl having a rim with a front edge and a rear edge;

(B) providing a portable bidet comprising a basin shaped to fit within and on the bowl of the toilet, and the basin having a wall, a front end region, a rear end region, and a bottom area, and the bottom area including (i) a hole adapted to receive liquid and fecal matter from the basin and discharge the liquid and fecal matter into the bowl, (ii) a generally flat portion and defining a generally medially disposed sloping surface, (iii) an oblique portion joining the sloping surface to the generally flat portion, with the sloping surface being inclined downwardly from the front end region to the rear end region, (iv) at least one ear adapted to removably attach the bidet to the rear edge of the rim of the bowl, and (v) at least one detent adapted to removably attach the bidet to the front edge of the rim of the bowl;

(C) positioning the bidet on the bowl, with (i) the ear removably attached beneath the rear edge of the rim of the bowl, (ii) the detent removably attached beneath the front edge of the rim of the bowl, (iii) the front end region adjacent to and extending laterally over and outwardly from the front edge of the rim, (iv) the flat portion generally horizontally disposed, and (v) the wall generally vertically disposed;

(D) placing the baby in the bidet; and (E) cleaning the baby.

16. The process of claim 15, wherein the bidet is about 22 inches long and about 15 inches wide, and the wall is about 4 inches to about 6 inches high.

17. The process of claim 15, wherein the wall has a shape selected from the group consisting of oval, rectangular, and combinations thereof.

18. The process of claim 15, wherein the hole is disposed in at least one of the sloping surface and the oblique portion.

19. The process of claim 15, wherein the generally flat portion is generally frame-shaped and is about 60% to about 80% of the bottom area.

20. The process of claim 15, wherein the sloping surface is about 20% to about 40% of the bottom area and about 12 inches long about 7.5 inches wide.

21. The process of claim 15, wherein the sloping surface is at an angle less than about 20 degrees with respect to the frame-shaped portion.

22. The process of claim 15, wherein the oblique portion is arced approximately to the same extent as the rear edge of the rim.

23. The process of claim 15, wherein the oblique portion at its tallest portion is about 2 inches high.

24. A process for cleaning a baby comprising:

(A) providing a toilet having a bowl, and the bowl having a rim with a front edge and a rear edge;

(B) providing a portable bidet comprising a basin shaped to fit within and on the bowl of the toilet, and the basin having a wall, a front end region, a rear end region, and a bottom area, and the bottom area including (i) a hole adapted to receive liquid from the basin and discharge the liquid into the bowl, (ii) a generally flat portion and defining a generally medially disposed sloping surface, (iii) an oblique portion joining the sloping surface to the generally flat portion, with the sloping surface being inclined downwardly from the front end region to the rear end region, (iv) at least one ear adapted to removably attach the bidet to the rear edge of the rim of the bowl, and (v) at least one detent adapted to removably attach the bidet to the front edge of the rim of the bowl;

(C) positioning the bidet on the bowl, with (i) the ear removably attached beneath the rear edge of the rim of the bowl, (ii) the detent removably attached beneath the front edge of the rim of the bowl, (iii) the front end region adjacent to and extending laterally over and outwardly from the front edge of the rim, (iv) the flat portion generally horizontally disposed, and (v) the wall generally vertically disposed;

(D) placing the baby in the bidet; and (E) cleaning the baby, wherein at least one of the sloping surface and the oblique portion of the bottom area includes the at least one ear.

25. A process for cleaning a baby comprising:

(A) providing a toilet having a bowl, and the bowl having a rim with a front edge and a rear edge;

(B) providing a portable bidet comprising a basin shaped to fit within and on the bowl of the toilet, and the basin having a wall, a front end region, a rear end region, and a bottom area, and the bottom area including (i) a hole adapted to receive liquid from the basin and discharge the liquid into the bowl, (ii) a generally flat portion and defining a generally medially disposed sloping surface, (iii) an oblique portion joining the sloping surface to the generally flat portion, with the sloping surface being inclined downwardly from the front end region to the rear end region, (iv) at least one ear adapted to removably attach the bidet to the rear edge of the rim of the bowl, and (v) at least one detent adapted to removably attach the bidet to the front edge of the rim of the bowl;

(C) positioning the bidet on the bowl, with (i) the ear removably attached beneath the rear edge of the rim of the bowl, (ii) the detent removably attached beneath the front edge of the rim of the bowl, (iii) the front end region adjacent to and extending laterally over and outwardly from the front edge of the rim, (iv) the flat portion generally horizontally disposed, and (v) the wall generally vertically disposed;

(D) placing the baby in the bidet; and (E) cleaning the baby, wherein the at least one detent includes a wedge with a depressible rubber hemisphere attached thereto.

26. The process of claim 25, wherein the wedge has first portion and a second portion and the first portion is affixed to the sloping surface, the depressible rubber hemisphere is attached to the second portion, and reciprocally engaging first and second teeth are provided respectively on first and second portions, so that detent is adjustable back and forth.

27. The process of claim 15, wherein the bidet is constructed of a material selected from the group consisting of plastic, metal, and a combination thereof.

28. The process of claim 15, further including providing an associated hose removably connected to a water faucet and turning the water faucet to its on position, so that water will flow through the hose and into the bidet for cleaning the baby.

* * * * *